US010119267B2

(12) United States Patent
Petzold et al.

(10) Patent No.: US 10,119,267 B2
(45) Date of Patent: Nov. 6, 2018

(54) HEAT-INSULATING CONSOLE FOR JOINING A FACADE TO A BUILDING WALL

(71) Applicant: Hilti Aktiengesellschaft, Schaan (LI)

(72) Inventors: Florian Petzold, Ulm (DE); Shahbaz Ali Abbas, Vienna (AT); Kay Brockmueller, Neustadt (DE); Andreas Wuest, Zwingenberg (DE); Torsten Hensel, Bensheim (DE); Klaus Uske, Bad Duerkheim (DE)

(73) Assignee: Hilti Aktiengesellschaft, Munich (DE)

( * ) Notice: Subject to any disclaimer, the term of this patent is extended or adjusted under 35 U.S.C. 154(b) by 407 days.

(21) Appl. No.: 14/759,605

(22) PCT Filed: Jan. 7, 2014

(86) PCT No.: PCT/EP2014/050112
§ 371 (c)(1),
(2) Date: Jul. 7, 2015

(87) PCT Pub. No.: WO2014/108378
PCT Pub. Date: Jul. 17, 2014

(65) Prior Publication Data

US 2015/0361651 A1 Dec. 17, 2015

(30) Foreign Application Priority Data

Jan. 9, 2013 (DE) ..... 10 2013 200 211

(51) Int. Cl.
*E04B 1/41* (2006.01)
*E04F 13/08* (2006.01)
(Continued)

(52) U.S. Cl.
CPC ..... *E04B 1/40* (2013.01); *E04B 1/7637* (2013.01); *E04F 13/0801* (2013.01);
(Continued)

(58) Field of Classification Search
CPC .. E04B 1/40; E04B 2001/405; E04F 13/0832; E04F 13/0833; E04F 13/0857; E04F 13/086; E04F 13/0862
(Continued)

(56) References Cited

U.S. PATENT DOCUMENTS 6,421,979 B1 * 7/2002 Fischer ..... B29C 65/56 403/363
6,910,311 B2 * 6/2005 Lindberg ..... E04C 3/07 52/588.1
(Continued)

FOREIGN PATENT DOCUMENTS

DE 3223343 A1 12/1983
DE 202004008376 9/2004
(Continued)

OTHER PUBLICATIONS

Epo translation EP2180115.*

*Primary Examiner* — Charles A Fox
*Assistant Examiner* — Joseph J. Sadlon
(74) *Attorney, Agent, or Firm* — Davidson, Davidson & Kappel, LLC

(57) ABSTRACT

A console for joining a façade to a building wall (100), including a metal wall part (1) for mounting on the building wall, a metal façade part (2) for joining to the façade, and a bridge part (3) that joins the façade part (2) to the wall part (1), whereby the bridge part (3) includes a plastic material and it forms a heat barrier between the wall part (1) and the façade part (2) is provided. The bridge part is an injection-molded part made of fiber-reinforced plastic, and in that the bridge part (3) is injection-molded around the wall part (1) and the façade part (2) so as to encapsulate them in certain areas.

15 Claims, 2 Drawing Sheets

(51) Int. Cl.
*E04B 1/76* (2006.01)
*E04B 1/38* (2006.01)

(52) U.S. Cl.
CPC ..... *E04F 13/0805* (2013.01); *E04F 13/0832* (2013.01); *E04F 13/0857* (2013.01); *E04B 2001/405* (2013.01)

(58) Field of Classification Search
USPC ..... 52/698
See application file for complete search history.

(56) References Cited

U.S. PATENT DOCUMENTS 7,125,466 B2 * 10/2006 Cooper ..... B62D 25/145 156/244.14
8,297,019 B2 * 10/2012 Lorenz ..... E04F 13/0805 52/407.4
8,833,025 B2 * 9/2014 Krause ..... E04F 13/0828 52/235
9,121,169 B2 * 9/2015 Hohmann, Jr. ..... E04B 1/7637
9,677,268 B2 * 6/2017 Knight ..... E04B 2/562
9,732,518 B2 * 8/2017 Croasdale ..... E04B 2/562
9,915,074 B2 * 3/2018 Duranleau ..... E04F 13/25
2005/0241111 A1 * 11/2005 Prokop ..... B25G 1/102 16/430
2007/0101671 A1 * 5/2007 Deeks ..... B29C 39/10 52/578
2009/0173029 A1 * 7/2009 Socha ..... E04B 1/82 52/506.08
2010/0117262 A1 * 5/2010 Gringer ..... B29C 45/1671 264/247

FOREIGN PATENT DOCUMENTS

DE 102007021431 11/2007
DE 102009056741 6/2011
EP 1084816 3/2001
EP 2180115 4/2010
EP 2180115 A1 * 4/2010 ..... E04F 13/0801
EP 2354368 8/2011
GB 686238 A * 1/1953 ..... E04B 1/40
GB 2398580 8/2004
RU 2305630 C2 9/2007
RU 2307906 C2 10/2007
RU 90091 U1 12/2009

* cited by examiner

HEAT-INSULATING CONSOLE FOR JOINING A FACADE TO A BUILDING WALL

The invention relates to a console for joining a façade to a building wall. Such a console is fitted with a metal wall part for mounting on the building wall, a metal façade part for joining to the façade, and a bridge part that joins the façade part to the wall part, whereby the bridge part comprises a plastic material and it forms a heat barrier between the wall part and the façade part.

BACKGROUND

A console of the generic type is disclosed in European patent application EP 2180115 A1. Such a console is provided with a bridge part that forms a heat barrier and thus counters undesired heat dissipation away from the wall via the console. Another console with a heat barrier is disclosed in German utility model DE 202004008376 U.

SUMMARY OF THE INVENTION

It is an object of the present invention to provide a console that is particularly cost-effective to produce and that is very reliable to install and use while, at the same time, having particularly good mechanical and thermal properties.

The present invention provides a console characterized in that the bridge part is an injection-molded part made of fiber-reinforced plastic, and in that the bridge part is injection-molded around the wall part and the façade part so as to encapsulate them, at least in certain areas, preferably only in certain areas.

A first basic idea of the invention can be seen in the fact that the bridge part encapsulates the wall part and of the façade part by means of injection-molding. In other words, the bridge part is joined to the wall part and to the façade part in that the latter are encapsulated by means of injection-molding, that is to say, during the production process, the material of the bridge part in the molten state is brought into contact with the wall part and the façade part, and the bridge part hardens as it comes into contact with the wall part and the façade part. Since, according to the invention, the bridge part is in the form of an injection-molded encapsulation, an especially good mechanical bond can be achieved in the console that is also particularly reliable in terms of the forces and the temperature fluctuations in the façade area.

According to the invention, the bridge part constitutes a heat barrier, in other words, a thermal insulator. In particular, the material of the bridge part has a lower thermal conductivity than the material of the wall part and of the façade part. The bridge part joins the façade part to the wall part, and the façade part is mechanically affixed to the wall part by means of the bridge part. Preferably, the façade part, especially when the façade has been dismantled, is joined to the wall part exclusively via the bridge part. In this manner, parallel heat flows can be prevented and an even better thermal insulation can be achieved. The façade part and/or the wall part are preferably joined directly to the bridge part, which can further simplify the production.

Moreover, the invention provides for the bridge part to be made of a fiber-reinforced plastic. As will be explained in detail below, such a plastic often displays thermal and mechanical properties that render it particularly well-suited for use in a console.

The façade preferably can be a rear-ventilated cladding for external walls, especially one according to standard DIN 18516-1, that is to say, the console is advantageously employed where a façade of a closed external wall is pre-installed. In particular, the invention can be used in combination with a layer of insulation material through which the console passes, whereby the bridge part is advantageously embedded into the insulation material layer. The façade suitably has a plurality of panels. The façade panels are preferably joined to the consoles according to the invention, particularly to their façade parts, by means of a support profile structure which especially can be made of metal. If a support profile structure is present, according to the invention, it can be seen as a constituent of the façade. Advantageously, the façade part of the console according to the invention has means to hold a support profile, for instance, a clamp.

It is especially preferable for the bridge part to have two support flanges which are at a distance from each other and which join the façade part and the wall part. In this manner, the forces that occur, especially wind forces, can be withstood very efficiently. Advantageously, the two support flanges of the bridge part, preferably exclusively the two support flanges, are injection-molded around of the wall part and of the façade part so as to encapsulate them in certain areas. This translates into a very compact design. The two support flanges preferably run parallel to each other and/or horizontally.

It is likewise advantageous for the bridge part to have four bars arranged in a cross, especially in a diagonal cross, by means of which the two support flanges are joined together. The intersection area of the four bars, in other words, the area where the four bars meet, is preferably situated between the two support flanges, especially in the center between the two support flanges. In particular, the gate mark of the bridge part configured as an injection-molded part can be at the intersection area of the bars. These bars can very easily and reliably stiffen the two support flanges so that especially the force of the weight of the façade can be supported very reliably. Moreover, this can give rise to a particularly advantageous combination of the cross shape of the bars and the use of fiber-reinforced plastic in an injection-molding process. After all, the design of the bridge part as a diagonal cross, that is to say, in the form of an X, can bring about a specific orientation of the fibers. In particular, the fibers can be oriented in such a way that the preferential direction of the fibers in the bars is parallel to the individual bars. In this manner, the fibers are oriented primarily diagonally and particularly in the direction of the main flux of force when under load due to wind forces and/or the force of the weight.

According to the invention, the four bars can encompass four fields, namely, especially two crosswise fields that open towards the support flanges, and two opposing lengthwise fields that open towards the wall part or the façade part. The crosswise fields suitably have a smaller opening angle than the lengthwise fields.

It is especially preferred for the material thickness of the bridge part in at least one of the lengthwise fields, preferably in both lengthwise fields, at least in certain areas, preferably everywhere, to be less than on the bars. As an alternative or in addition, it is advantageous for the material thickness of the bridge part in at least one of the crosswise fields, preferably in both crosswise fields, at least in certain areas, preferably everywhere, to be less than on the bars. These embodiments take into account the fact that the forces that occur can essentially already be absorbed by the connection flanges and the bars, so that the fields located between the bars can be configured so as to be relatively weak, without this entailing any major mechanical losses. Since the material in the fields can thus be relatively thin, the thermal insulating property of the bridge part can be further improved, without this entailing any major mechanical losses. According to the invention, the term "material thickness" refers to the thickness in a direction running perpendicular to the fields and/or perpendicular to the cross shape of the bars. In a properly mounted console, this direction can preferably be the horizontal direction. The four bars preferably have a constant material thickness and/or they all have the same material thickness gradient.

In particular, the material thickness in at least one of the lengthwise fields, preferably in both lengthwise fields, can be equal to zero, at least in certain areas. For this reason, it is especially preferred for at least one of the two lengthwise fields to have at least one opening. Advantageously, both lengthwise fields have at least one opening. These openings can form, for example, air cushions that can even further reduce the heat conductivity of the bridge part. The term "opening" refers especially to a cutout that passes through the bridge part perpendicular to the fields and/or perpendicular to the cross shape of the bars.

It is likewise advantageous for at least one of the crosswise fields to be closed, preferably completely, so that it advantageously does not have an opening. In particular, both crosswise fields can be closed, preferably completely. This can be advantageous with an eye towards the mechanical stability. With this embodiment, in certain cases, it is also possible to prevent or at least reduce the formation of seams in the area of the connection flange. Preferably, a higher percentage of the surface of the crosswise fields is closed than in the case of the lengthwise fields.

It is also preferred for the wall part to have a plate element with two opposing flat sides and two opposing lengthwise sides, and/or for the façade part to have a plate element which has two opposing flat sides and two opposing lengthwise sides and which runs preferably coplanar to the plate element of the wall part. This can be advantageous in terms of the production work involved. In particular, the wall part and/or the façade part can be configured in the form of an extruded part. The wall part can have, for instance, a mounting plate that is placed on the wall from which the plate element of the wall part protrudes, especially at a right angle. The façade part can have a holding clamp that projects from the plate element of the façade part, whereby a support profile of the support profile structure of the façade can be clamped between the holding clamp and the plate element of the façade part. Preferably, an end face of the façade part faces an end face of the wall part. In a properly mounted console, the bars and the two plates advantageously run in at least one vertical plane, preferably in precisely one vertical plane.

In particular, it can be provided that the opposing lengthwise sides of the wall part and/or the opposing lengthwise sides of the façade part are enclosed in some areas by the bridge part, whereby the bridge part preferably creates a snug fit for the opposing lengthwise sides of the wall part or for the opposing lengthwise sides of the façade part. Thanks to this snug fit on the lengthwise side, the force of the weight of the façade can be transferred very effectively.

According to the invention, the fiber-reinforced plastic has a matrix and a plurality of fibers. The matrix can especially be a thermoplastic, for instance, a polyamide, preferably polyamide 6.6.

Another preferred configuration of the invention lies in the fact that the coefficient of thermal expansion of the matrix is greater, and the coefficient of thermal expansion of the fibers is smaller, than the coefficient of thermal expansion of the two plate elements. This can again yield an advantageous interaction with the geometry according to the invention since, due to the fact that the preferential direction of the fibers in the bars advantageously runs parallel to each individual bar, the coefficient of thermal expansion of the bars as seen along the bars is between the coefficient of thermal expansion of the fibers and the coefficient of thermal expansion of the plastic matrix. Therefore, in this preferred configuration, the thermal expansion of the bridge part can be adapted to the thermal expansion of the adjacent metal wall part and/or to that of the adjacent metal façade part, so that an undesired thermal stress at the transition from the bridge part to the wall part or else at the transition from the bridge part to the façade part can be avoided. Owing to the fiber orientation along the diagonals, the thermal expansion of the plastic can bed made to approximate the thermal expansion of the adjacent metal.

Advantageously, it can be provided that the four bars, preferably the four bars and the two support flanges, especially preferably the entire bridge part, are mirror symmetrical to one plane of symmetry, preferably to two planes of symmetry. A plane of symmetry can especially be perpendicular to the cross shape of the bars and can run through the wall part and the façade part. In a properly mounted console, this plane of symmetry is preferably in the horizontal. A symmetrical design can be advantageous in terms of the mechanical properties and/or the fiber orientation. In particular, the symmetrical configuration can make it possible to install the console in several orientations at identical load values, which also simplifies the use.

Another advantageous refinement of the invention is that the gate mark of the bridge part is in at least one plane of symmetry of the bridge part. As a result, the fiber orientation and/or the mechanical properties can be further improved.

It is particularly preferred for the bridge part to have precisely one gate mark, which simplifies the production.

Preferably, it can be provided that a gate mark of the bridge part is situated in an intersection area of the four bars, in other words, especially in the center of the diagonals. Owing to the geometry according to the invention and to the selection of a gate mark in a plane of symmetry and/or in the intersection area of the bars, the fibers in the bridge part can be systematically oriented, as a result of which the following is attained:

a) The thermal expansion of the plastic molded part approximates the thermal expansion of the metal parts that are touching each other. This minimizes mechanical stresses in the component when temperatures fluctuate.

b) The main flux of force runs in the fiber direction, thus utilizing the greater material strength in the fiber direction.

Preferably, the wall part and/or the façade part has/have a ribbed structure that is encapsulated by the bridge part by means of injection-molding. This permits a better transfer of force between the individual parts. In particular, the ribbed structure can be provided on the plate element of the wall part or of the façade part. Each ribbed structure suitably has a plurality of ribs that run on at least one flat side, preferably on both flat sides, of the appertaining plate element and/or parallel to the end face of the appertaining plate element.

It is likewise preferred for the bridge part to be configured as a single piece. This reduces the production work and improves the mechanical stability even further. In particular, the bars and the connection flanges can be configured as a single piece.

BRIEF DESCRIPTION OF THE DRAWINGS

The invention will be explained in greater detail on the basis of preferred embodiments that are schematically depicted in the accompanying figures, whereby individual features of the embodiments presented below can be implemented in conjunction with the invention either individually or else in any desired combination. The figures show the following schematically.

DETAILED DESCRIPTION

Figure 1:
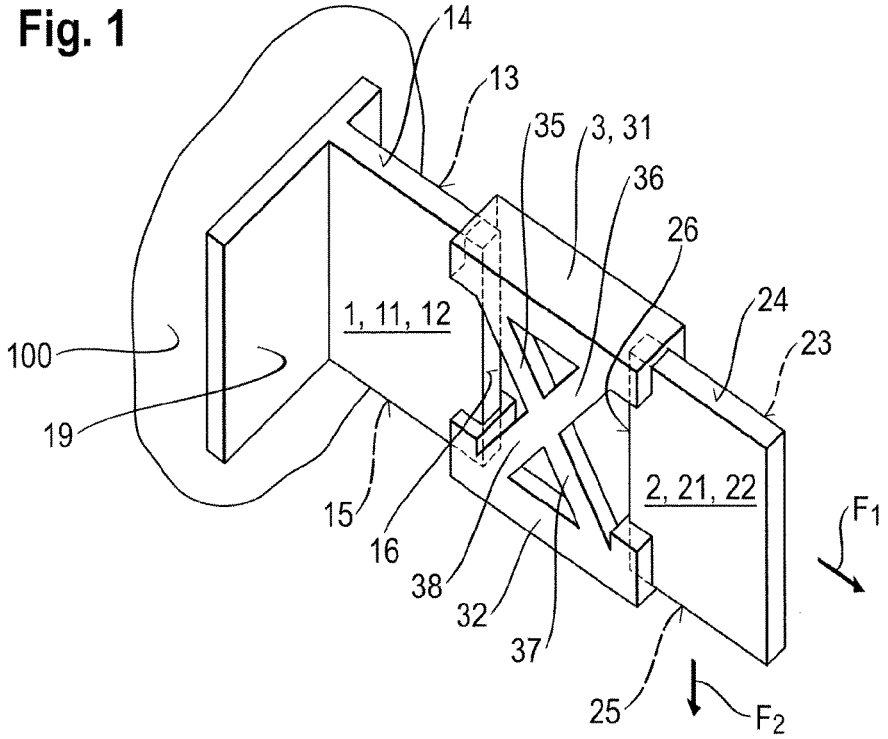
FIG. 1: a first embodiment of a console according to the invention, in a perspective view.

Identically functioning elements are designated by the same reference numerals in the figures.

Figure 2:
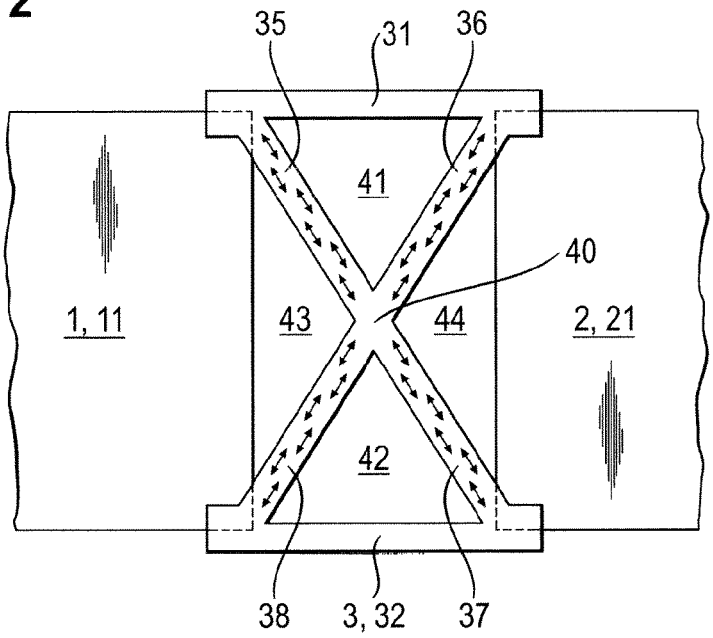
FIG. 2: a detailed view of the console according to FIG. 1, from the side.

A first embodiment of a console according to the invention is shown in FIGS. 1 and 2. The console has a wall part 1 that is mounted on a building wall 100, a façade part 2 that is mounted on a façade, as well as a bridge part 3 that mechanically holds the façade part 2 on the wall part 1, thereby creating a heat barrier between the wall part 1 and the façade part 2.

The wall part 1 has a mounting plate 19 that lies flat on the building wall 100, and a plate element 11 which projects from the mounting plate 19 at a right angle and on which the bridge part 3 is arranged. The façade part 2 likewise has a plate element 21. The plate element 21 of the façade part 2 is supported by the bridge part 3. In this context, the plate element 21 of the façade part 2 runs parallel—and coplanar in the embodiment shown—to the plate element 11 of the wall part 1.

The plate element 11 of the wall part 1 has two opposing flat sides 12 and 13, two opposing narrow lengthwise sides 14 and 15 as well as a narrow, free end face 16. The plate element 21 of the façade part 2 likewise has two opposing flat sides 22 and 23, two opposing narrow lengthwise sides 24 and 25 as well as a narrow, free end face 26. The free end face 26 of the façade part 2 and the free end face 16 of the wall part 1 face each other as well as the bridge part 3.

When the flat sides 12, 13, 22 and 23 and/or the end faces 16 and 26 have been properly installed, as a rule, they run vertically, that is to say, the lengthwise sides 14 and 24 are above the lengthwise sides 15 and 25, respectively. Fundamentally, however, installation in which the flat sides 12, 13, 22 and 23 run horizontally or obliquely is also possible.

The bridge part 3 is an injection-molded part made of fiber-reinforced plastic. It has a first, preferably upper, support flange 31, and a second, preferably lower, support flange 32. The two support flanges 31, 32 run at a distance from each other, preferably in the horizontal direction, each from the wall part 1 to the façade part 2, and they join the façade part 2 to the wall part 1. In this context, the two support flanges 31 and 32 of the bridge part 3 are injection-molded around the wall part 1 and the façade part 2 so as to encapsulate them. Each one of the two support flanges 31 and 32 is in contact with the two flat sides 12 and 13 of the wall part 1 and with the two flat sides 22 and 23 of the façade part 2. Preferably, the first support flange 31 can also be in contact with the lengthwise side 14 of the wall part 1 and the lengthwise side 24 of the façade part 2, and/or the second support flange 32 can be in contact with the lengthwise side 15 of the wall part 1 and with the lengthwise side 25 of the façade part 2.

The bridge part 3 also has four bars 35, 36, 37, 38 which are joined together by means of the two support flanges 31, 32 and which stiffen the two support flanges 31 and 32 with respect to each other. The four bars 35, 36, 37, 38 form a cross shape and run in a parallel, especially coplanar, plane to the plate elements 11 and/or 21, whereby the intersection area of the four bars 35, 36, 37, 38, in other words, the area where the four bars 35, 36, 37, 38 meet, is situated in the center between the two support flanges 31 and 32. The four bars 35, 36, 37, 38 and the two support flanges 31 and 32 are configured so as to be mirror-symmetrical to a plane that is perpendicular to the cross shape of the four bars 35, 36, 37, 38 and that runs between the two support flanges 31 and 32 (in FIG. 2, this plane of symmetry is perpendicular to the drawing plane and runs from left to right). The four bars 35, 36, 37, 38 and the two support flanges 31 and 32 are also configured so as to be mirror-symmetrical to another plane of symmetry which is perpendicular to the cross shape of the four bars 35, 36, 37, 38 and which intersects the two support flanges 31 and 32 (in FIG. 2, this second plane of symmetry is perpendicular to the drawing plane and runs from top to bottom).

The gate mark 40 of the bridge part, in other words, the area where the fiber-reinforced plastic material was fed into the mold during the injection-molding process, is located in the intersection area of the four bars 35, 36, 37, 38. In the four bars 35, 36, 37, 38, the preferential direction of the fibers of the fiber-reinforced plastic material is approximately parallel to the appertaining bar, as indicated by arrows in FIG. 2.

In the plane of their cross shape, the four bars 35, 36, 37, 38 enclose four fields 41, 42, 43, 44, namely, two diametrically opposing crosswise fields 41 and 42 that, starting from the intersection area of the bars 35, 36, 37, 38, open towards the support flange 31 or the support flange 32, and two diametrically opposing lengthwise fields 43 and 44 that, starting from the intersection area of the bars 35, 36, 37, 38, open towards the wall part 1 or the façade part 2. The crosswise fields 41 and 42 have a smaller opening angle than the lengthwise fields 43 and 44.

In the embodiment shown, the fields 41, 42, 43, 44 are not filled with plastic material and they each form an opening. However, the fields 41, 42, 43 and/or 44 can also be filled with plastic material. The following then preferably applies to the material thicknesses: $0 \leq a \leq b \leq c$, wherein a stands for the material thickness in the individual lengthwise field(s) 43 and/or 44, b stands for the material thickness in the individual crosswise field(s) 41 and/or 42, and c stands for the material thickness in at least one of the bars 35, 36, 37, 38, preferably in all of the bars.

This relationship is not limited to the embodiment shown in FIGS. 1 and 2, but rather, can also be employed for other geometries according to the invention.

The console shown in FIGS. 1 and 2 especially can withstand the force F1, for example, the wind force on the façade and the force F2, for instance, the force of the weight of the façade.

Figure 3:
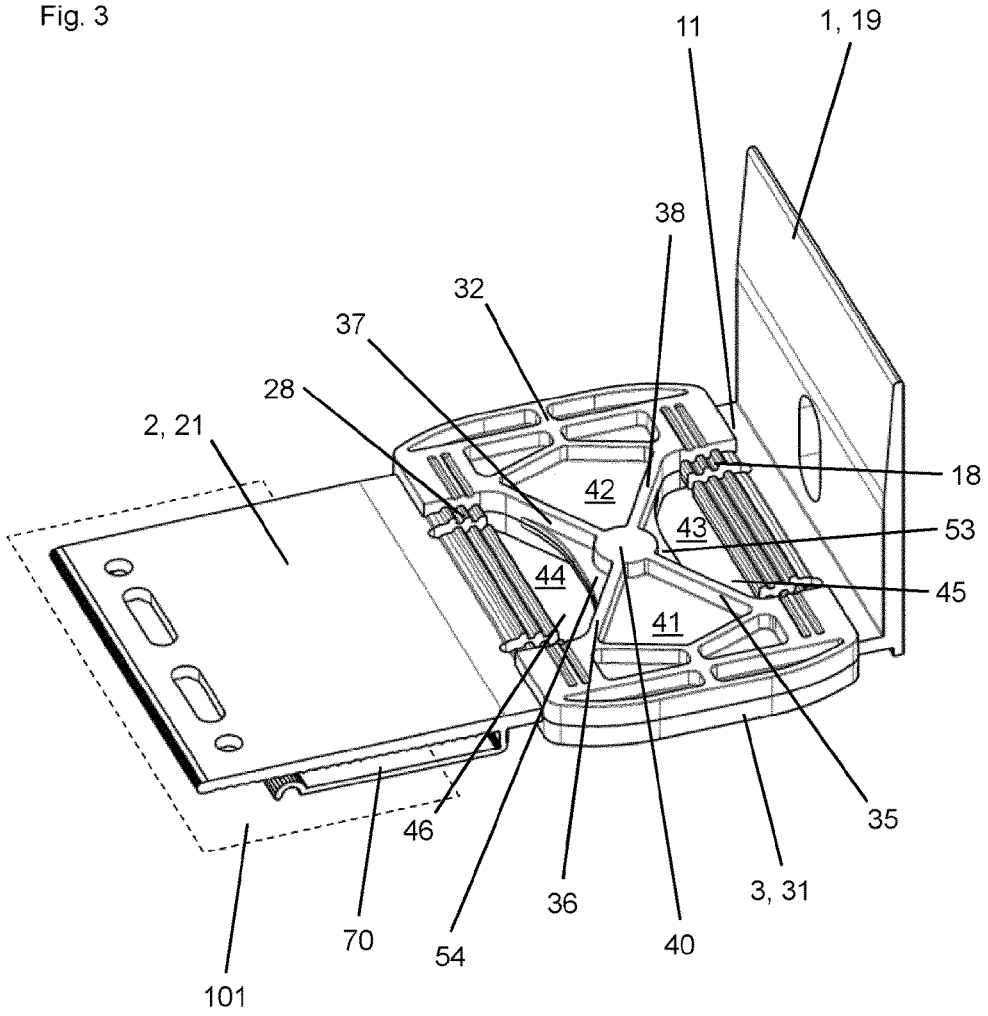
FIG. 3: a second embodiment of a console according to the invention, in a perspective view.

Another embodiment of the console according to the invention is shown in FIG. 3. The embodiment of FIG. 3 implements a number of features of the embodiment from FIGS. 1 and 2 in an analogous manner, so that the above-mentioned description can be employed analogously and only the differences will be elaborated upon below.

The support flanges 31 and 32 in the embodiment of FIG. 3 are structured. They have struts and depressions located between the struts.

The crosswise fields 41 and 42 in the embodiment of FIG. 3 are completely filled. In the lengthwise fields 43 and 44, there are struts 53 and 54 that adjoin the intersection area of the bars 35, 36, 37, 38 and whose material is thinner than that of the bars 35, 36, 37, 38. Moreover, the lengthwise fields 43 and 44 have openings 45 and 46. The strut 53 is located between the opening 45 and the intersection area, while the strut 54 is located between the opening 46 and the intersection area. The surface area of the strut 53 is smaller than the adjacent opening 45, and the surface area of the strut 54 is smaller than the adjacent opening 46.

In the embodiment of FIG. 3, the plate elements 11 and 12 of the wall part 1 and the façade part 2, respectively, have a ribbed structure 18 and 28, on which the bridge part 3 is joined to the wall part 1 or to the façade part 2. The mounting plate 19 of the wall part 1 has a hole through which an anchor bolt can be inserted in order to anchor the mounting plate 19 to the building wall. The façade part 2 of FIG. 3 has a holding clamp 70 that is arranged on the plate element 21 of the façade part 2. During the installation procedure, a support profile 101—only shown in rough schematic form in sections—of the support profile structure of the façade can be held temporarily by clamping between the holding clamp 70 and the plate element 21. In the plate element 21 of the façade part 2, there are openings that allow the temporarily clamped support profile 101 to be permanently screwed to the façade part 2.

What is claimed is:

1. A console for joining a façade to a building wall, comprising:

a metal wall part for mounting on the building wall;

a metal façade part for joining to the façade; and a bridge part joining the façade part to the wall part, the bridge part including a plastic material and forming a heat barrier between the wall part and the façade part, the bridge part being an injection-molded part made of fiber-reinforced plastic, and the bridge part being injection-molded around the wall part and the façade part so as to encapsulate the wall part and the façade part at least in certain areas.

2. The console as recited in claim 1 wherein the bridge part has two support flanges at a distance from each other and joining the façade part and the wall part, the two support flanges of the bridge part being injection-molded around the wall part and the façade part so as to encapsulate the wall part and the façade part in the certain areas.

3. The console as recited in claim 2 wherein the bridge part has four bars arranged in a cross joining the two support flanges are joined together.

4. The console as recited in claim 3 wherein the cross is a diagonal cross.

5. The console as recited in claim 3 wherein the four bars can encompass two crosswise fields opening towards the support flanges and two lengthwise fields opening towards the wall part or the façade part, a material thickness of the bridge part in the lengthwise fields being less than on the bars, or the material thickness of the bridge part in the crosswise fields being less than on the bars.

6. The console as recited in claim 5 wherein the lengthwise fields have at least one opening, and the crosswise fields are closed.

7. The console as recited in claim 3 wherein a fiber orientation of the fiber-reinforced plastic in the bars is approximately parallel to individual bars of the four bars.

8. The console as recited in claim 3 wherein a gate mark of the bridge part is situated in an intersection area of the four bars.

9. The console as recited in claim 1 wherein the wall part has a wall plate element with two opposing flat sides and two opposing lengthwise sides, and the façade part has a plate element having two opposing flat sides and two opposing lengthwise sides, the opposing lengthwise sides of the wall part or the opposing lengthwise sides of the façade part being enclosed in some areas by the bridge part.

10. The console as recited in claim 9 wherein the façade part runs coplanar to the wall plate element of the wall part.

11. The console as recited in claim 9 wherein the bridge part creates a snug fit for the opposing lengthwise sides of the wall part or for the opposing lengthwise sides of the façade part.

12. The console as recited in claim 9 wherein the fiber-reinforced plastic has a matrix and a plurality of fibers, whereby a coefficient of thermal expansion of the matrix is greater than a coefficient of thermal expansion of the of the wall plate element and the plate element, and a coefficient of thermal expansion of the fibers is smaller than the coefficient of thermal expansion of the wall plate element and the plate element.

13. The console as recited in claim 1 wherein the wall part and the façade part have a ribbed structure encapsulated by the bridge part via injection-molding.

14. The console as recited in claim 1 wherein the bridge part is configured as a single piece.

15. The console as recited in claim 1 wherein the bridge part includes an overmolding encapsulating the wall part and the façade part in the certain areas.

* * * * *